United States Patent [19]

Becker et al.

[11] Patent Number: 4,461,258

[45] Date of Patent: Jul. 24, 1984

[54] REGULATING DEVICE FOR A FUEL METERING SYSTEM OF AN INTERNAL COMBUSTION ENGINE

[75] Inventors: Wolfram Becker, Eberdingen; Albrecht Clement, Kornwestheim; Rolf Däumer, Weil der Stadt, all of Fed. Rep. of Germany

[73] Assignee: Robert Bosch GmbH, Stuttgart, Fed. Rep. of Germany

[21] Appl. No.: 300,711

[22] Filed: Sep. 9, 1981

[30] Foreign Application Priority Data

Oct. 18, 1980 [DE] Fed. Rep. of Germany ..... 3039436

[51] Int. Cl.[3] ..... F02M 51/00

[52] U.S. Cl. ..... 123/440; 123/489

[58] Field of Search ..... 123/440, 489, 480, 486

[56] References Cited

U.S. PATENT DOCUMENTS 4,174,680 11/1979 Anzai ..... 123/489
4,224,910 9/1980 O'Brien ..... 123/440
4,306,523 12/1981 Takeda ..... 123/440
4,348,727 9/1982 Kobayashi et al. ..... 123/440
4,348,728 9/1982 Sagisaka et al. ..... 123/440
4,355,616 10/1982 Tamura et al. ..... 123/440

*Primary Examiner*—Parshotam S. Lall
*Attorney, Agent, or Firm*—Edwin E. Greigg

[57] ABSTRACT

A regulating device is proposed for a fuel metering system of an internal combustion engine having λ regulation. The regulating device includes a P-I regulator, and the individual control variables of the regulator are stored in memory and are capable of being recalled in accordance with operating characteristics. By means of asymmetrical P and I components that is, different values at the transition from a lean to a rich mixture or vice versa, the average value for λ can be shifted in a clearly-defined manner, so that the individual exhaust gas components are substantially adapted to the desired values at all operational points. The individual P and I components or regulator control variables are stored in memory in performance graphs, which preferably permit finely-distinguished regulator control during partial-load operation.

5 Claims, 4 Drawing Figures

REGULATING DEVICE FOR A FUEL METERING SYSTEM OF AN INTERNAL COMBUSTION ENGINE

BACKGROUND OF THE INVENTION

The invention is based on a regulating device for a fuel metering system of an internal combustion engine having a proportional and integrating regulator having a memory storing individual control variables which are capable of being selectively recalled.

It is known to use a proportional-integral regulator for the purposes of so-called λ control, and to drive this regulator in accordance with the λ sensor output signal. It has now since been demonstrated, however, that this known regulator does not function with sufficient precision in all operational states, and thus does not always contribute to attaining both a clean exhaust and acceptable driving smoothness. This is particularly true in transitional states such as during acceleration or overrunning in marginal ranges.

OBJECT AND SUMMARY OF THE INVENTION

The regulating device according to the invention has the advantage over known devices that, with the invention, the individual components of the exhaust gas can be quite well adapted to the desired values at all operational points. This is attained by means of the appropriate selection of the proportional and integral elements relating to the dead times of the system, which are dependent on rpm and on load and are caused by the gas-running period or times and the dead time of the λ sensor.

It has proved to be particularly advantageous to select the individual integral and proportional values differently, and furthermore to distribute the individual rpm and/or load values such that there are various degrees of fine distinctions over the entire range.

The invention will be better understood and further objects and advantages thereof will become more apparent from the ensuing detailed description of a preferred embodiment taken in conjunction with the drawings.

DESCRIPTION OF THE EXEMPLARY EMBODIMENT

Figure 1:
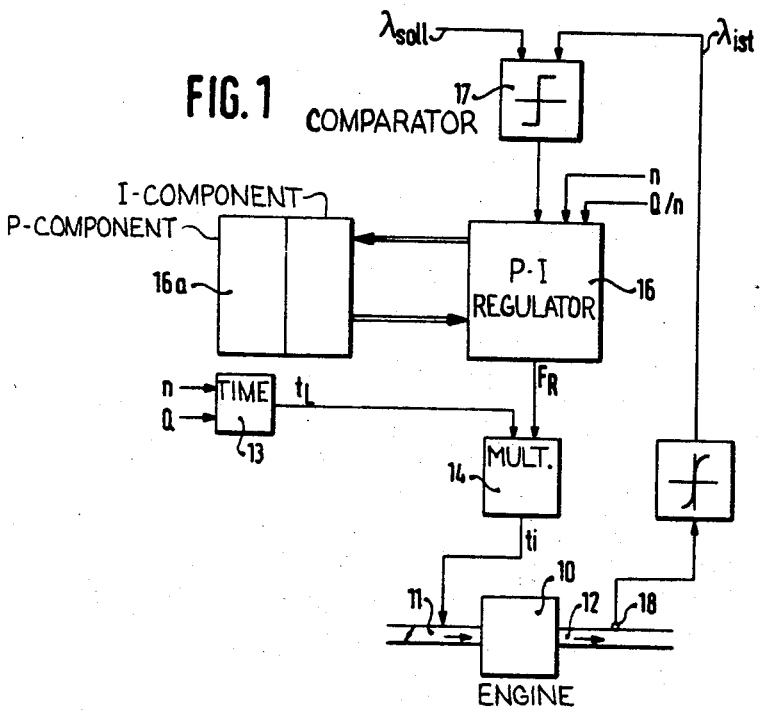
FIG. 1 is a schematic block circuit diagram of the regulating device for a fuel metering system of an internal combustion engine according to a best mode and preferred embodiment of the invention.

In the form of a schematic block circuit diagram, FIG. 1 shows a regulating device for a fuel metering system in an internal combustion engine with externally supplied ignition. The engine 10 has an air intake tube 11 and an exhaust line 12. On the basis of rpm and load, a timing element 13 determines a basic injection time signal of duration $t_L$, which is multiplicatively corrected in a subsequent multiplier circuit 14, is then furthermore additionally varied in accordance with the operational range, and is finally delivered to a fuel metering valve (not shown) in the vicinity of the air intake tube 11.

A correction factor $F_R$ is derived from a P-I regulator 16, which has performance graphs 16a for regulating parameters associated with it. The input variables of the P-I regulator 16 are signals relating to load, rpm and exhaust gas composition. A comparator 17 furnishes this signal relating to the exhaust gas composition and in this comparator 17, an actual λ value derived from a λ sensor 18 is compared with a set-point λ value and the output of the comparator is applied to the P-I regulator 16.

The individual components shown in FIG. 1 are known per se. Most of them are conventional components which are commercially available. The P-I regulator 16 which has been noted may be realized as a conventional programmed computercontrolled unit, for example, a programmed microcomputer or an individually wired counter. For an analog version, a conceivable embodiment would be one in which operational amplifiers, wired as proportional amplifiers and as integrators, are influenced by the digitally stored performance graph data in such a manner that the amplification factors of these amplifier circuits are varied in accordance with the engine operating parameters. It may be attained with individual modules in such a manner that predetermined values are transferred to a counter in order to create the P component, while in order to realize the I component, this counter is exposed to a predetermined counting frequency.

Figure 2:
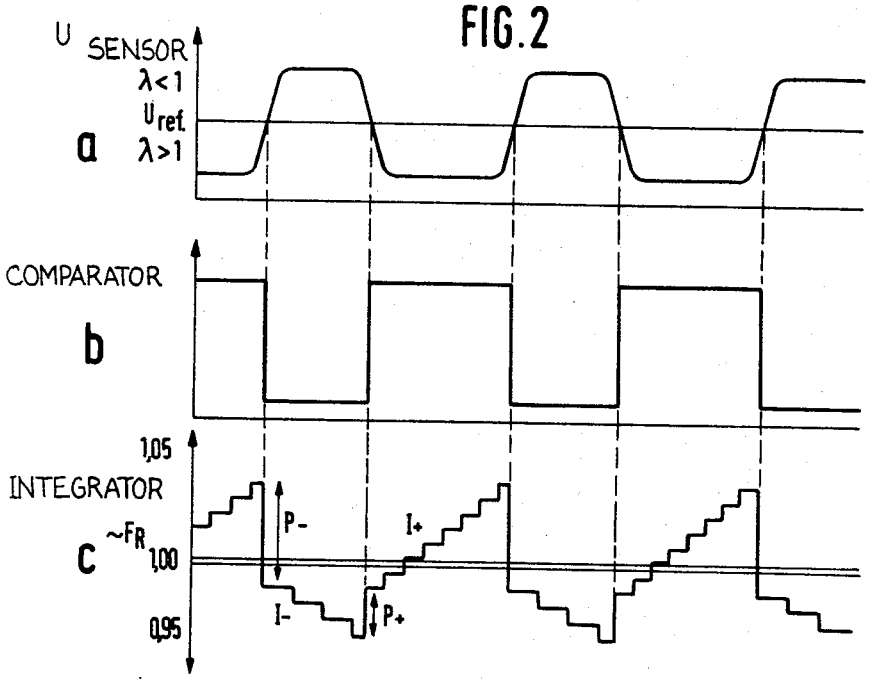
FIG. 2 is a pulse diagram serving to explain the mode of operation of the subject of FIG. 1.

The mode of operation of the subject of FIG. 1 will now be explained with the aid of the curves or waveforms shown in FIG. 2. Curve FIG. 2a represents the output signal of the λ sensor 18. In FIG. 2b, the comparator output signal is shown. This signal controls the respective switchover point in the P-I regulator 16 (see FIG. 2c). From the third curve shown in FIG. 2, it may be seen that there is a respective jump in the regulator output signal in accordance with the P component, which is followed by a stairstep function in accordance with the algebraic sign of the jump. In this manner, the result attained is thus a proportional-integral behavior.

As shown in FIG. 2c, the two P components have different values, and furthermore the I component has different slopes, which are realizable, for instance, by means of a variable counting frequency in accordance with the counting direction.

In order to attain a high regulating frequency, the positive and negative P components should be selected such that each amounts to at least half the momentary regulating oscillation. In some cases, for reasons having to do with exhaust emissions, for instance, however, allowances will have to be made for a low frequency, in order to be able to attain a desired finely-distinguished asymmetry. By the appropriate selection of the proportional and integral components, the regulation can be adapted to the rpm-dependent and load-dependent dead times of the system, which are determined by the gas-running times and by the dead time of the λ sensor.

By means of asymmetrical P and I components, or in other words different values at the transition from lean to rich or rich to lean mixtures, the average value for λ can be shifted in a clearly-defined manner such that the individual exhaust gas components are substantially adapted to the desired values at all operational points.

The steepness of the integrator slope of the regulator is automatically adapted to the rpm, because the I regulator is retroactively adjusted by a predetermined number of $t_i$ increments upon each revolution of the crankshaft.

With a view to precise adaptation of the regulation to engine operation, the regulating parameters may be freely selected in the form of performance graphs.

Figure 3:
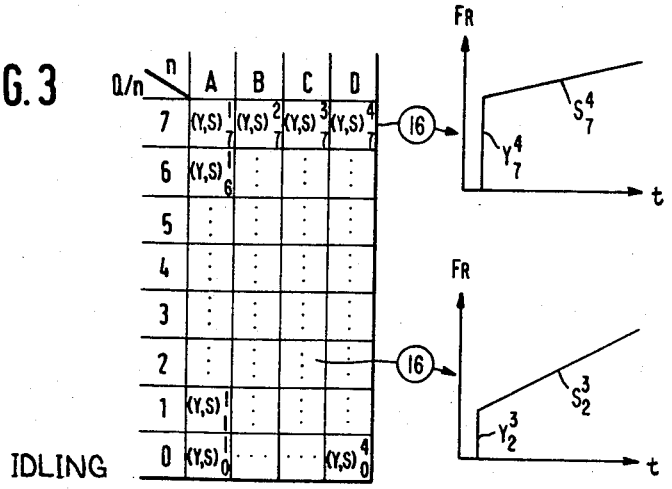
FIG. 3 is a schematic representation of an individual load-rpm performance graph for providing the proportional or integral values of the regulator.

FIG. 3 shows one example of a performance graph of this kind, in which both the individual P and I components can be stored in memory in the form of slope values. In the illustrated example, four rpm columns A-D and a total of eight load columns 0-7 are provided. The load range is therefore generally selected such that it has finer increments or distinctions, because the load dependency must be taken more heavily into consideration in fuel metering. Line 0, for instance, can thus contain the individual values for idling, and the remaining lines 1-7 are associated with finely distributed partial-load ranges. There is no line provided here for full load, because at this operational range the λ regulation is preferably switched off anyway and the fuel metering accomplished with open-loop control instead. As shown, the P and I components are represented as variables $y_m^n$ and $s_m^n$ respectively. As a result of the influence of these variables y, s on the PI regulator 16, which can be realized either digitally by means of a suitable program on digital components or in analog fashion by means of operational amplifiers, the output variable $F_R$ is thus obtained. Two values, $(Y,S)_7^4$ and $(Y,S)_2^3$, are illustrated in FIG. 3. By means of the digitally stored values Y, S, for example, the output variable $F_R$ of the PI regulator 16 has definite P and I components dependent on the operating parameters Q, N. Thus the P and I component (4,5) are illustrated in the sub-figures of FIG. 3 as 7D and 2C, respectively. These values of course are representative of all the slope values for $F_R$ for each of the rpm columns A-D and each of the load columns 0-7, as indicated, for example, in FIG. 4.

Figure 4:
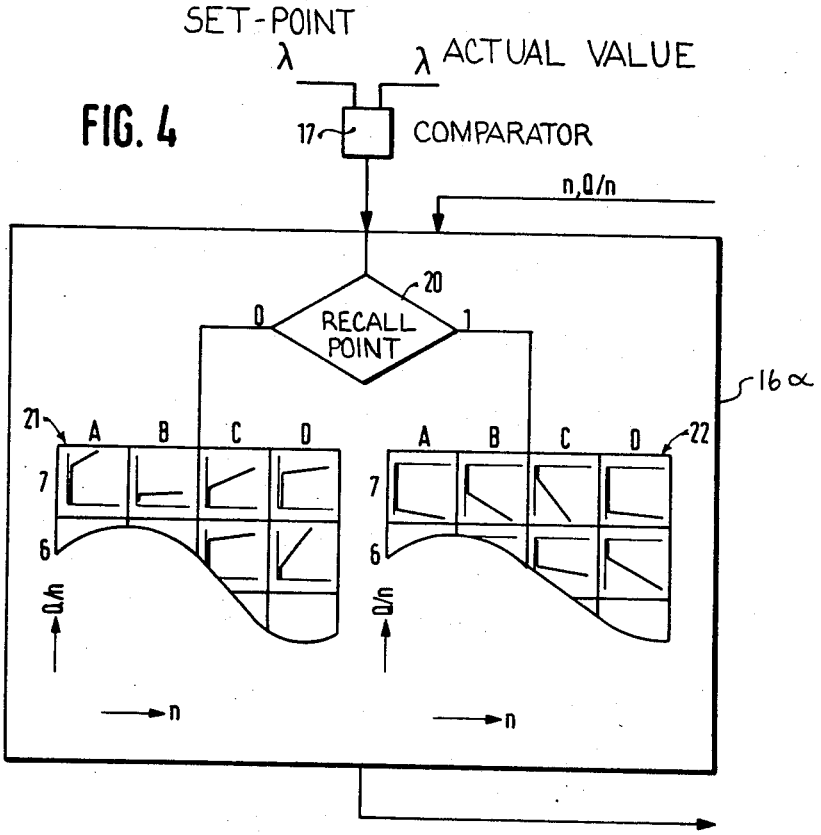
FIG. 4 is a schematic block circuit diagram for the mode of operation of the memory containing the performance graphs.

FIG. 4 is intended to further explain the fundamental structure of the P-I regulator. There, the output signal of the comparator 17 proceeds to a recall point 20 and there, depending on the comparator output signal, a positive or negative jump and slope value for the P-I regulator is read out of memories 21, 22. The data which have respectively been read out are then further processed in the actual P-I regulator 16.

The regulating parameters can be selected by way of the individual values stored in memory, which are ascertained experimentally and are specific for a particular engine type, such that the lowest possible value is produced for all components of the exhaust gas. However, the regulation can equally well be intentionally "mis-tuned" at individual points so as to reduce the total result of a test for a desired component (such as NO or $NO_x$). At rpm-load points where there is a heavy emission of NO- or $NO_x$ (during acceleration, for instance), it is possible to execute a slight shift toward $\lambda<1$, for instance, or to effect a shift toward lean mixtures at operational points where there are heavy emissions of hydrocarbons.

The direction of the shift (toward rich or lean) and its magnitude can thus be fixed individually for each point of the performance graph.

Because the integrator slope is fixed as a variable per ignition or per revolution (for instance, i-increments per revolution or one increment per revolution of the crankshaft), an adaptation to the rpm at a particular time is automatically obtained.

It is accordingly possible to cite the following as advantages of the regulating device according to the invention:

The performance graph base points are freely selectable in terms of their number and their distribution in the load and rpm direction depending upon requirements such as those having to do with a test cycle and vehicle type.

The direction of a desired λ shift and the magnitude of the shift can be independently fixed for each point in the performance graph.

The size of the regulating stroke is individually selectable for each point in the performance graph by way of the magnitude of the P components or of the steepness of the slope of the integrator.

As a result, both reduced toxic emissions and improved during smoothness are attained as well.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A regulating device for a fuel metering system of an internal combustion engine comprising:

a sensor in the exhaust tube producing a sensor signal, a metering signal generating circuit including a P-I regulator having a memory means wherein the individual P components and the slope values for the I components are stored in said memory means for positive and negative signal waveforms, whereby the values for the P and I components stored in said memory means are selectively assymmetrical or symmetrical, said regulator producing metering signals in accordance with engine operating characteristics and the sensor signal, said operating characteristics include said individual components as regulating parameters stored in said memory means, and means for selectively recalling said parameters from said memory means in accordance with said engine operating characteristics.

2. A regulating device as defined by claim 1, wherein the values for the P and I components stored in said memory means are selectively asymmetrical and symmetrical.

3. A regulating device as defined by claim 1, wherein said individual parameters are recalled in accordance with rpm and load values.

4. A regulating device as defined by claim 3, wherein said rpm and load values in the partial-load range are recalled by relatively finely distributed and sensitive increments of values of said regulating parameters.

5. A regulating device as defined by claim 1, wherein said individual parameters are recalled in accordance with acceleration and deceleration.

* * * * *